US005569128A

United States Patent [19]

Dalebout

[11] Patent Number: 5,569,128

[45] Date of Patent: Oct. 29, 1996

[54] LEG AND UPPER BODY EXERCISER

[75] Inventor: William T. Dalebout, Logan, Utah

[73] Assignee: ICON Health & Fitness, Inc., Logan, Utah

[21] Appl. No.: 534,084

[22] Filed: Sep. 26, 1995

Related U.S. Application Data

[63] Continuation of Ser. No. 191,009, Feb. 3, 1994, abandoned.

[51] Int. Cl.[6] ..... A63B 21/00

[52] U.S. Cl. ..... 482/57; 482/62

[58] Field of Search ..... 482/57, 62, 63, 482/64, 65, 148, 908

[56] References Cited

U.S. PATENT DOCUMENTS 3,057,201 10/1962 Jaeger ..... 482/57
4,717,146 1/1988 Nohara ..... 482/62
5,160,305 11/1992 Lin ..... 482/57
5,342,261 8/1994 Johnston ..... 482/57

FOREIGN PATENT DOCUMENTS 2390179 12/1978 France ..... 482/62

OTHER PUBLICATIONS

Brochure for Cardio-Exercise Treadmills; pp. 1–32.

*Primary Examiner*—Stephen R. Crow
*Attorney, Agent, or Firm*—Trask, Britt & Rossa

[57] ABSTRACT

A multipurpose pedal-type exercise device comprising a frame having a seat thereon, a pedal assembly having an adjustable resistance, and a multiposition adjustment mechanism connecting the pedal assembly to the frame to provide the user the capability of adjusting the position of the pedal assembly to compensate for the variation in the user's position during use of the pedal assembly.

5 Claims, 8 Drawing Sheets

LEG AND UPPER BODY EXERCISER

This application is a continuation of application Ser. No. 08/191,009, filed Feb. 3, 1994, now abandoned.

BACKGROUND OF THE INVENTION

1. Field of the Invention

The present invention relates generally to multipurpose upper body exercising devices which are also used as leg exercising devices. More specifically, the present invention relates to a multipurpose pedal-type exercise device which may be used, when in a seated position, to exercise either the upper body or the legs or, when in a standing position, to exercise the upper body.

2. State of the Art

The prior art contains examples of exercise devices which incorporate pedal-type exercise devices which may be used to exercise the upper body or the legs while either in seated, standing or reclining positions.

For instance U.S. Pat. No. 2,209,034 illustrates a frame forming a seat having a pedal spindle connected an adjustable length tube supporting a pedal system which includes a set of two pedals with straps to hold the user's feet thereon and an adjustable means for a brake of the drum and ribbon type.

Disclosed and illustrated in U.S. Pat. No. 3,738,649 is a conventional upholstered armchair having a concealed, extensible exercising apparatus on a movable platform. The platform supports a bicycle pedal device with pedals and a suitable means for providing resistance to rotation of the pedals.

Illustrated in U.S. Pat. No. 4,140,312 is an adjustable multi-purpose exercise device having a handle bar, saddle and a pedal mechanism with an inertial mass. In addition to the saddle the device includes an adjustable frame and seat which allows the user to rotate the pedal mechanism either from the saddle with the user's legs, from a seat in a horizontal position with the user's legs, or in a horizontal position for a user to lie on their belly while operating the pedal mechanism.

Alternatively, illustrated in French Patent 1,468,272 is a pedal-type exercise device having an adjustable seat assembly and an adjustable pedal mechanism having, in turn, a resistance mechanism. The pedal-type exercise device may be used to exercise the upper body or the legs when the user is in different positions.

In published German Patent OFFENLEGUNGSSCHRIFT 2,712,875 a pedal-type exercise device is illustrated having a pedal device which may be used with a chair or alone by a user. The pedal-type exercise device may have a spring-type resistance connected to the pedals.

Illustrated in the Executive Home Gymnasium materials is an exercise device having a pedal-type exercise device which may be used either in a leg shaping manner or in a bust shaping manner by the user.

SUMMARY OF THE INVENTION

The multipurpose pedal-type exercise device of the present invention comprises a frame having a seat thereon, a pedal assembly having an adjustable resistance, and a multiposition adjustment mechanism connecting the pedal assembly to the frame to provide the user with the capability of adjusting the position of the pedal assembly to compensate for the variation in the user's position on the seat, length of legs, provide for exercising of the user's legs and upper body, and provide the user with a variety of types of exercise, such as pedaling, swimming, rowing, etc.

The pedal-type exercise device may further comprise vibration, heat, massage and a control system therefore in the frame and seat for the comfort of the user either alone or in combination with the use of the pedal assembly. In that manner, the user may exercise the upper body or the legs as desired while in a position most suitable to the user and the preferred type of exercise.

BRIEF DESCRIPTION OF THE DRAWINGS

The present invention will be more fully understood by one of ordinary skill in the art when taken in conjunction with the detailed description of the present invention and the following drawings, wherein.

DETAILED DESCRIPTION OF THE INVENTION

Figure 1:
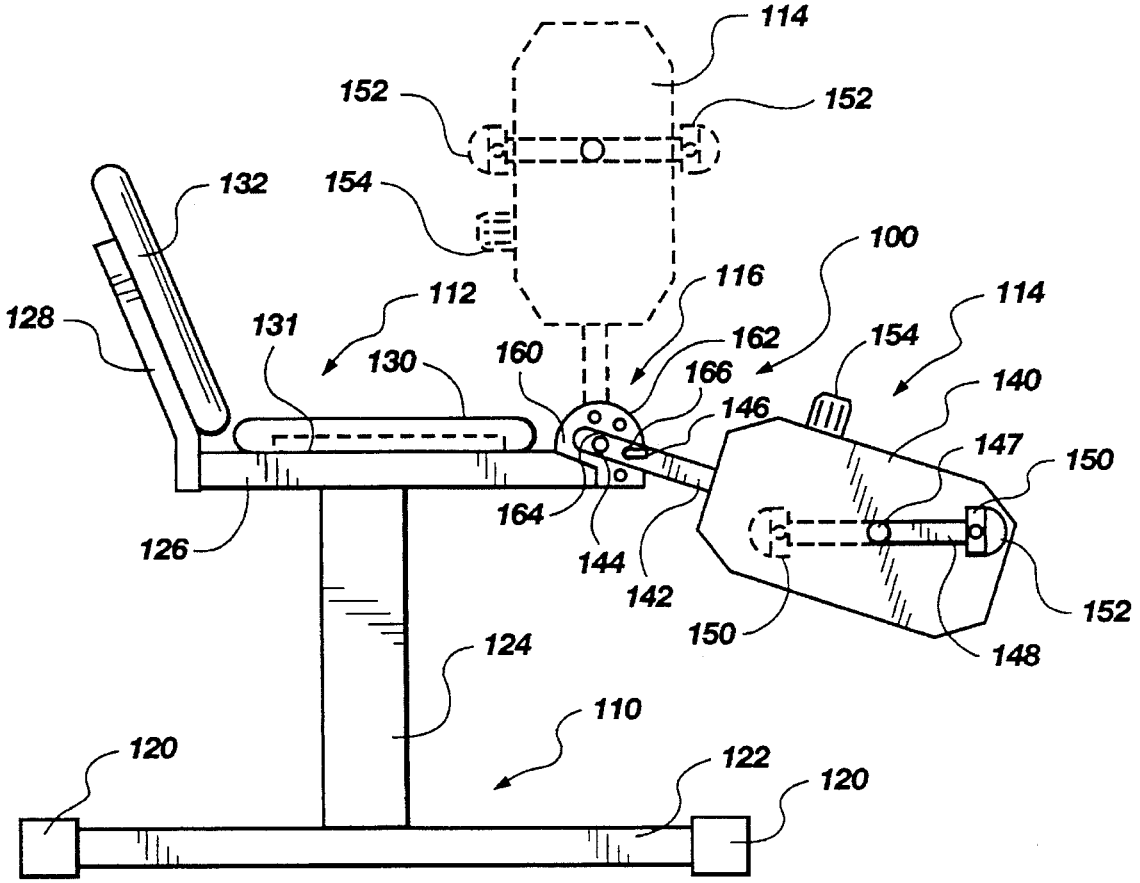
FIG. 1 is a side view of one embodiment of the present invention.

Referring to FIG. 1 of the drawings, an embodiment of the multipurpose exercise device 100 of the present invention comprises a frame 110, seat 112, pedal assembly 114, and multiposition pedal adjustment assembly 116.

The frame 110 includes front end cross members 120, connecting support 122 rear end cross members 120, vertical support 124 extending vertically from connecting support 122, horizontal seat support 126 connected to the upper end of vertical support 124, and seat back support 128 connected to the horizontal seat support 126.

The seat includes seat cushion 130 connected to the horizontal seat support 126 and seat back 132 connected to the seat back support 128. The seat cushion 130 may be connected to the horizontal seat support 126 of frame 110 by means of a suitable adjustment mechanism 131 to allow the seat cushion to be translated along the support 126 in any desired position thereon. A suitable adjustment mechanism amy be in the form of a clamping assembly, threaded rod assembly, plate and pin assembly, etc. A suitable seat adjustment mechanism is disclosed in U.S. Pat. No. 4,932,650 which is hereby incorporated by reference.

The pedal assembly 114 includes a housing 140, housing support 142 having an aperture 144 in one end thereof and an aperture 146 in a portion thereof, and pedal arms 148 having pedals 150 thereon. The pedals 150 may include hand loops 152 thereon. The pedal assembly 114 includes a flywheel assembly having a belt and adjustable spring resistance means thereon to provide the desired amount of resistance during use of the pedals 150. An adjustment knob 154 is illustrated on the housing 140. The pedal arms 148 are removably attached to shaft 147 by any suitable means to allow reorienting of the pedal arms 148 so that they extend in opposite directions or the same direction or any desired direction for use.

The multiposition pedal adjustment assembly 116 includes one or more plates 160 having a plurality of apertures 162 therein and a pin 164 connected thereto connected, in turn, to the end of horizontal seat support 126. The pin 164 extends through aperture 144 in one end of housing support 142 of pedal assembly 114 to rotatably mount the pedal assembly 114 with respect to the frame 110. To secure the pedal assembly 114 in a desired position by the user, a pin 166 extends through aperture 146 of housing support 142 of pedal assembly 114 to engage an aperture 162 in plates 160 of assembly 116. In this manner, the pedal assembly 114 may be selectively rotated and secured in a variety of desired positions by the user with respect to the frame 110 and seat 112 to allow use of the pedal assembly 114 by the legs of the user or, when in the pedal assembly 114 is in an upright position shown in phantom, to allow use of the pedal assembly 114 by the arms of the user for upper body exercise.

Figure 2:
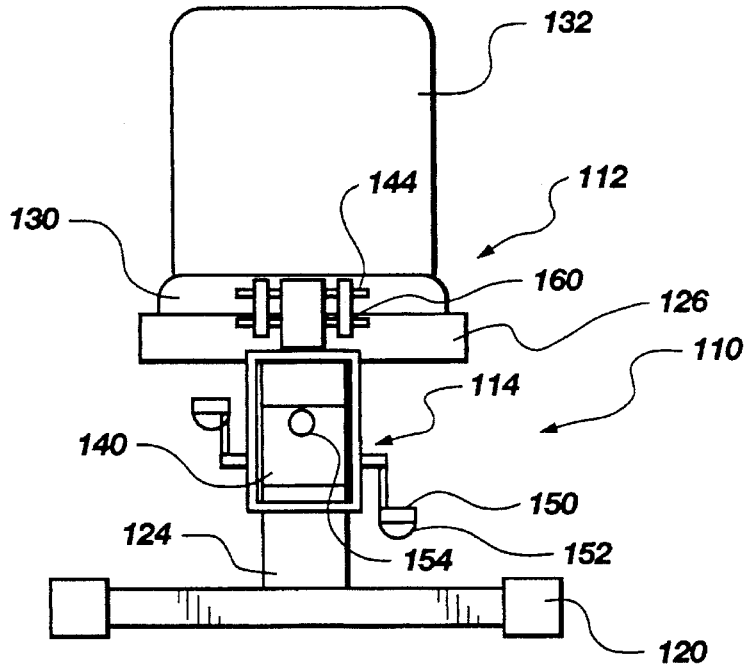
FIG. 2 is a front view of the embodiment of the present invention as shown in FIG. 1.

Referring to drawing FIG. 2, the multipurpose exercise device 100 of the present invention is shown. As shown, the frame 110 includes front end cross member 120, vertical support 124 and horizontal seat support 126. The seat cushion 130 and seat back 132 are illustrated.

The pedal assembly 114 is shown in its lower position with respect to the horizontal seat support 126 and seat cushion 130 for use as a pedal-type exercise device for the legs of a user seated on the frame 110.

Figure 3:
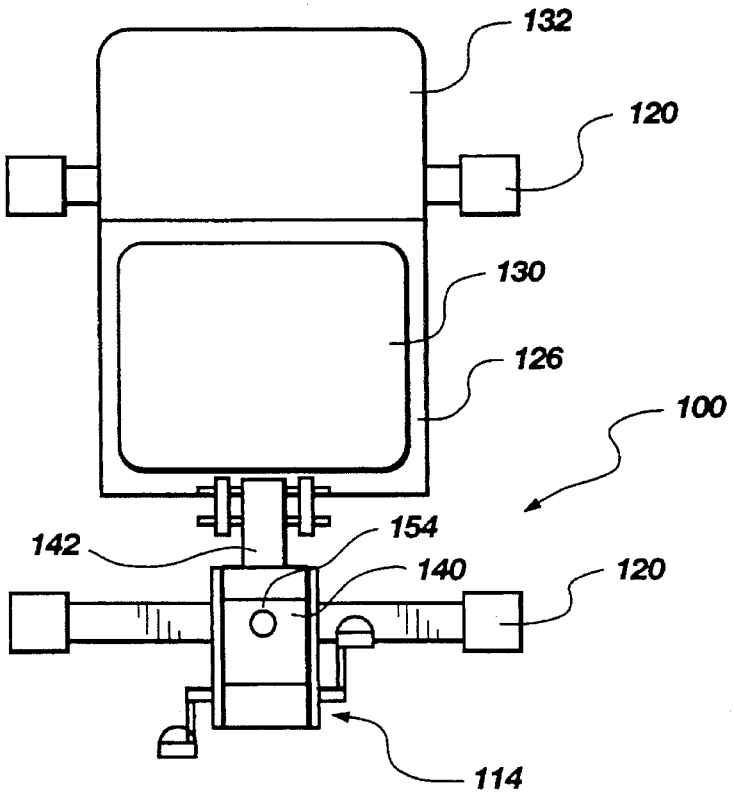
FIG. 3 is a top view of the embodiment of the present invention as shown in FIG. 1.

Briefly referring to drawing FIG. 3, the multipurpose exercise device 100 of the present invention is shown to illustrate the relationship of the pedal assembly 114 with respect to the horizontal seat support 126.

Figure 4:
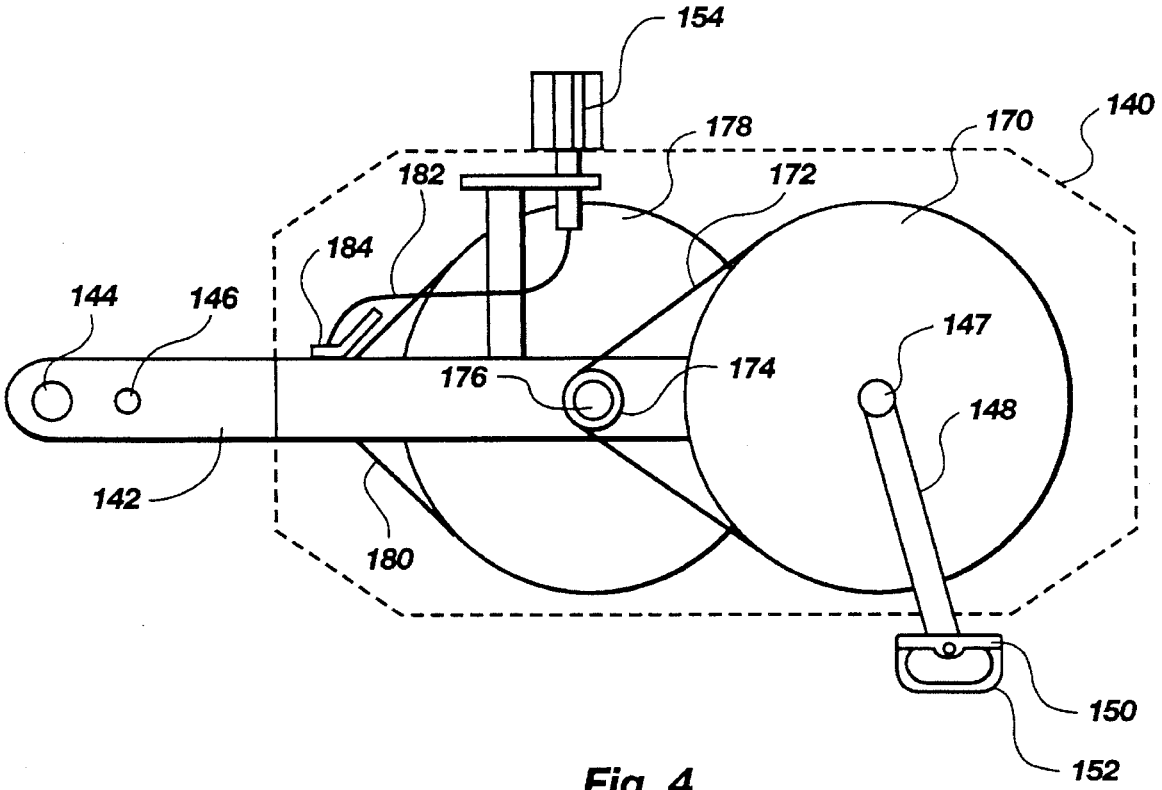
FIG. 4 is a partial view of the pedal assembly of the embodiment of the present invention as shown in FIG. 1.

Referring to drawing FIG. 4, the pedal assembly 114 is shown with the housing 140 being shown in phantom for convenience.

The pedal assembly 114 comprises a pulley 170 connected via drive chain 172 to pulley 174 on shaft 176 connected to flywheel 178. Engaging the periphery of flywheel 178 is tension belt 180 which further engages spring tension device 184 which, in turn, may adjust the tension on belt 180 via cable 182 connected to adjustment knob 154. The tension belt, spring tension device and adjustment knob may be any suitable type. Similarly, the drive chain 172 and tension belt 180 may be of any suitable type.

Figure 5:
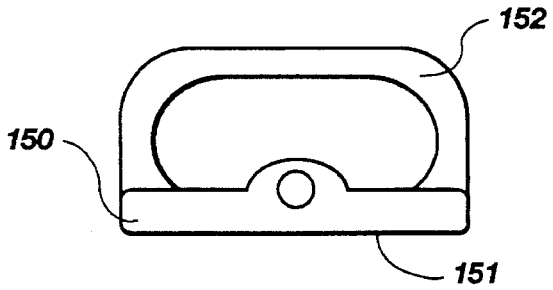
FIG. 5 is a side view of the pedal of the embodiment of the present invention as shown in FIG. 1.

Referring to drawing FIG. 5, the pedal 150 is shown to illustrate the foot pedal face 151 upon which a user's foot is placed when using the multipurpose exercise device 100 for pedal-type exercises and the hand loop 152 in which a user's hand is placed to use the device 100 for suitable upper body exercises when the pedal assembly 114 is rotated to a substantially-vertical position.

Figure 6:
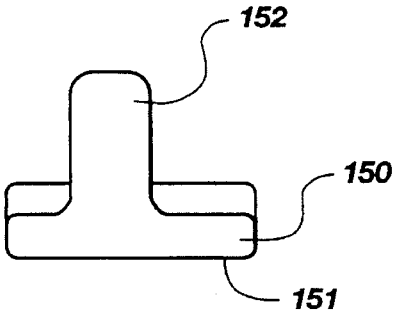
FIG. 6 is a front view of the pedal as shown in FIG. 5.

Referring to FIG. 6, the pedal 150 is shown to further illustrate the pedal face 151 and hand loop 152.

Figure 7:
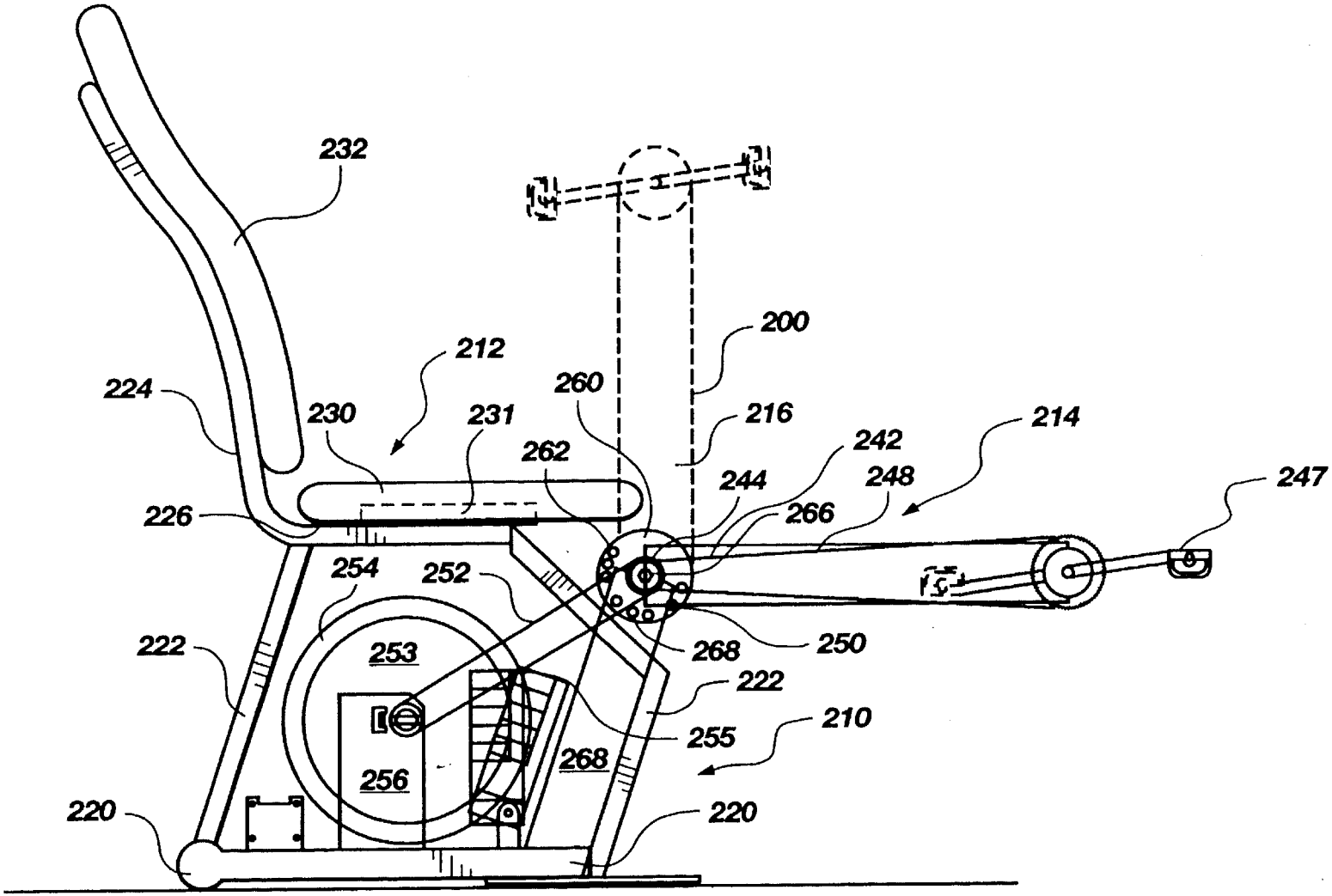
FIG. 7 is a side view of a second embodiment of the present invention.

Referring to FIG. 7 of the drawings, a second embodiment 200 of the multipurpose exercise device of the present invention comprises a frame 210, seat 212, pedal assembly 214, and multiposition pedal adjustment assembly 216.

The frame 210 includes a lower rectangular box frame having bottom members 220, vertical members 222, seat and back support members 224, and seat plate 226. The frame 210 may include suitable covers extending between bottom members 220 and vertical members 222.

The seat 212 includes seat cushion 230 connected seat plate 226 and seat back 232 connected to a portion of the seat and back support members 224. The seat cushion 230 may be connected to the seat plate 226 by means of a suitable adjustment mechanism 231 to allow the seat cushion to be translated along the seat plate 226 in any desired position thereon. A suitable adjustment mechanism may be in the form of a clamping assembly, threaded adjustment, plate and pin assembly, etc. such as hereinbefore set forth.

The pedal assembly 214 includes a housing support 242 having an aperture 244 in one end thereof, and aperture 246 in a portion thereof, pedals 247 and sprocket 246 rotatably connected to the other end of housing support 242, chain 248 connecting the sprocket of pedals and sprocket 246 to sprocket 250 on a drive shaft having, in turn, a pulley thereon which, in turn, is connected by belt 252 to eddy brake resistance device 254 mounted via supports 256 to portions of frame 210 beneath the seat 230. The eddy brake resistance device 254 may be any suitable design for use in an exercise device. The pedals 247 are the same type shown hereinbefore in drawing FIGS. 5 and 6.

The eddy brake resistance device 254 includes flywheel 253 and adjustable magnet assembly 255. By adjusting the relationship of the magnet assembly 255 with respect to the flywheel 253, the resistance of the flywheel to turning may be varied. Any suitable adjustment means may be mounted on frame 210 to allow adjustment of the magnet assembly 255 with respect to the flywheel 253.

The multiposition pedal adjustment assembly 216 includes at least one plate 260 connected to housing support 242 of pedal assembly 214 having a plurality of apertures 262 therein and a pin 264 rotatably interconnecting housing support 242 via aperture 244 to support 266 which, in turn, is connected to portions of frame 210. To secure the pedal assembly 214 in a desired position by the user a pin 268 extends through aperture 262 of plate 260 connected to housing support 242 and extends into an aperture in support 266. In this manner, the pedal assembly 214 may be selectively rotated and secured in a variety of desired positions by the user with respect to the frame 210 and seat 212 to allow use of the pedal assembly 214 by the legs of the user or, when the pedal assembly 214 is in an upright position shown in phantom, to allow use of the pedal assembly 244 by the arms of the user for upper body exercise whether seated or standing.

Figure 9:
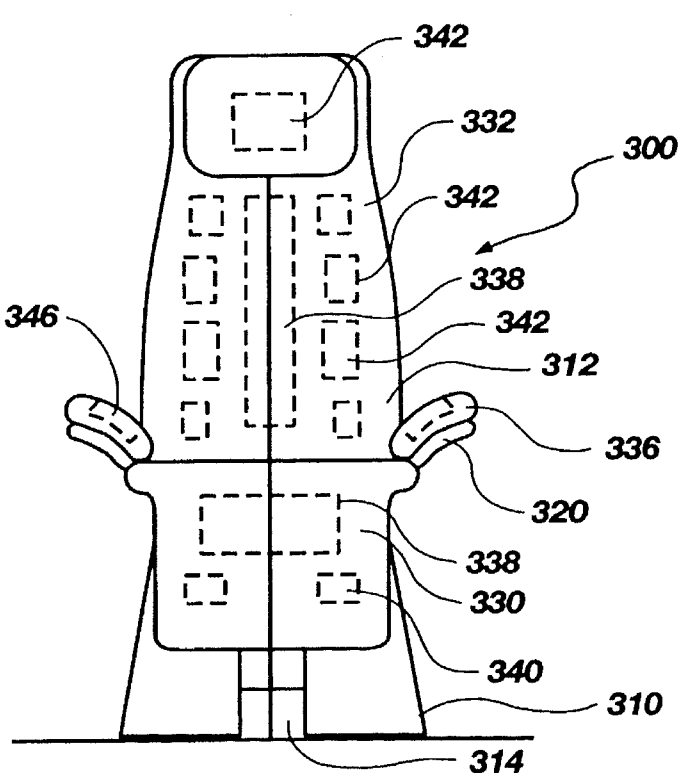
FIG. 9 is a front view of the third embodiment of the present invention as shown in FIG. 8.
Figure 8:
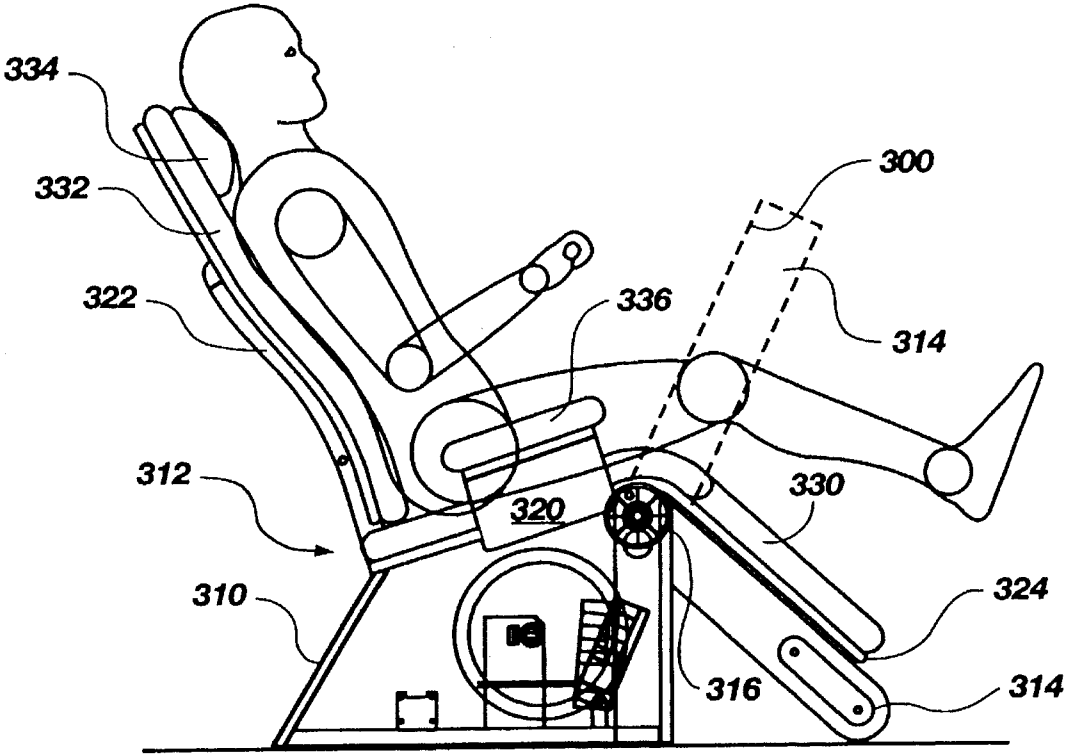
FIG. 8 is a side view of a third embodiment of the present invention.

Referring to FIGS. 8 and 9 of the drawings another embodiment 300 of the multipurpose exercise device of the present invention comprises a frame 310, seat 312, pedal assembly 314 and multiposition pedal adjustment assembly 316.

The frame 310 is similar in construction to that previously described but is more extensive to provide greater support for a user including arm rests 320, an extended back portion 324 and leg support portion 324.

The seat 312 includes seat and removable leg cushion 330, back cushion 332 having head rest 334 thereon and arm cushions 336. The seat 312 further includes, as desired, a plurality of heating areas 338, vibration areas 340 and massage areas 342. The heating areas 338, vibration areas 340 and 342 are controlled and activated by suitable control means 346 located at any desired position, such as on the arm rest area of these at 312.

The heating areas 338 may be any suitable type electric resistance-type heating devices. The vibration areas 340 may be of any suitable type such as a plate and cam/roller arrangement. The massage areas 342 may be of any suitable type such as a plurality of rollers and threaded shaft, plurality of rollers mounted on a plurality of arms with a common actuator, etc.

The pedal assembly 314 is similar in construction to that previously discussed herein.

Similarly, the multiposition pedal adjustment assembly 316 is similar in construction to that previously discussed herein.

Figure 10:
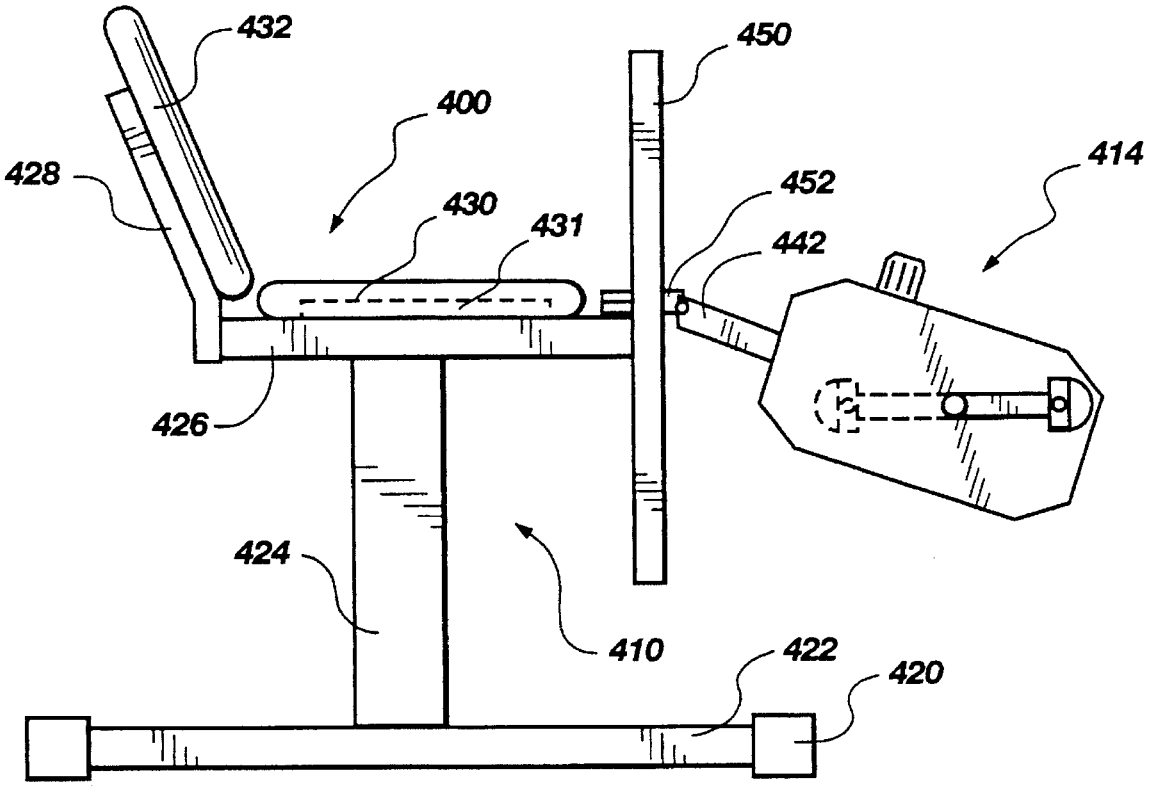
FIG. 10 is a side view of a fourth embodiment of the present invention.
Figure 11:
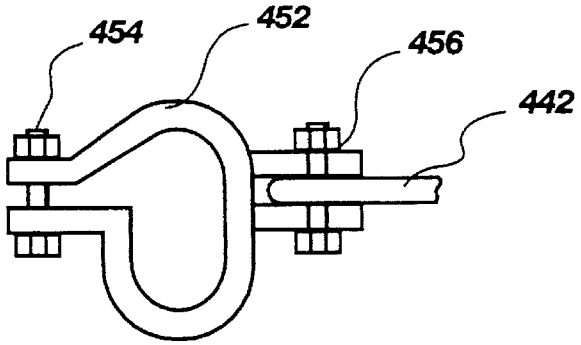
FIG. 11 is a top view of the clamp at the end of the pedal assembly of the fourth embodiment of the present invention.

Referring to drawing FIGS. 10 and 11 another embodiment 400 of the present invention is shown. The frame 410 is similar to that described hereinbefore. The pedal assembly 414 is slidably mounted on vertical pipe 450 connected to horizontal seat support 426 by any suitable means. The pedal assembly 414 is slidably connected to pipe 450 via clamp 452. The clamp 452 is retained and secured on pipe 450 by threaded member 454 while pedal arm 442 is secured to clamp 452 via threaded member 456 engaging aperture 458 in one end of pedal arm 442.

Figure 12:
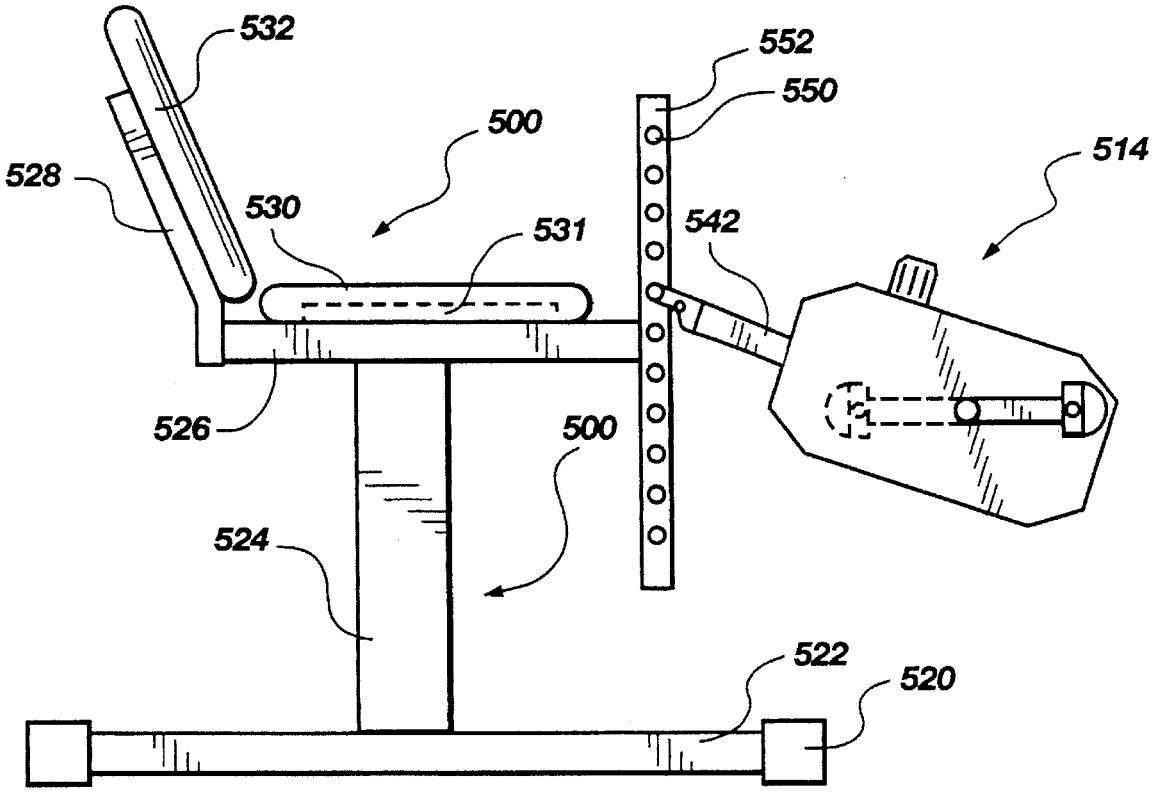
FIG. 12 is a side view of a fifth embodiment of the present invention.
Figure 13:
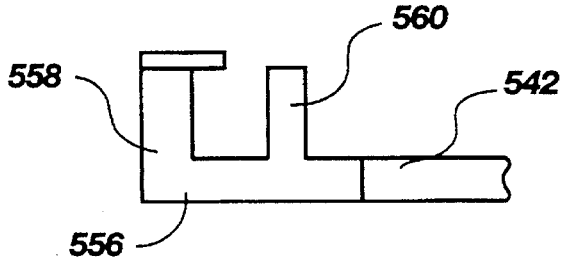
FIG. 13 is a top view of the hook attachment of the fifth embodiment of the present invention.

Referring to drawing FIGS. 12 and 13 another embodiment 500 of the present invention is shown. The pedal assembly 514 engages apertures 550 in vertical bar 552. The frame 510 and pedal assembly 514 are similar to that described hereinbefore. Located on the end of pedal arm 542 is hook and lug member 556 having hook portion 558 which engages one aperture 550 in bar 552 while lug member 560 abuts the exterior surface of bar 552 to position the pedal assembly 514 thereon.

Figure 14:
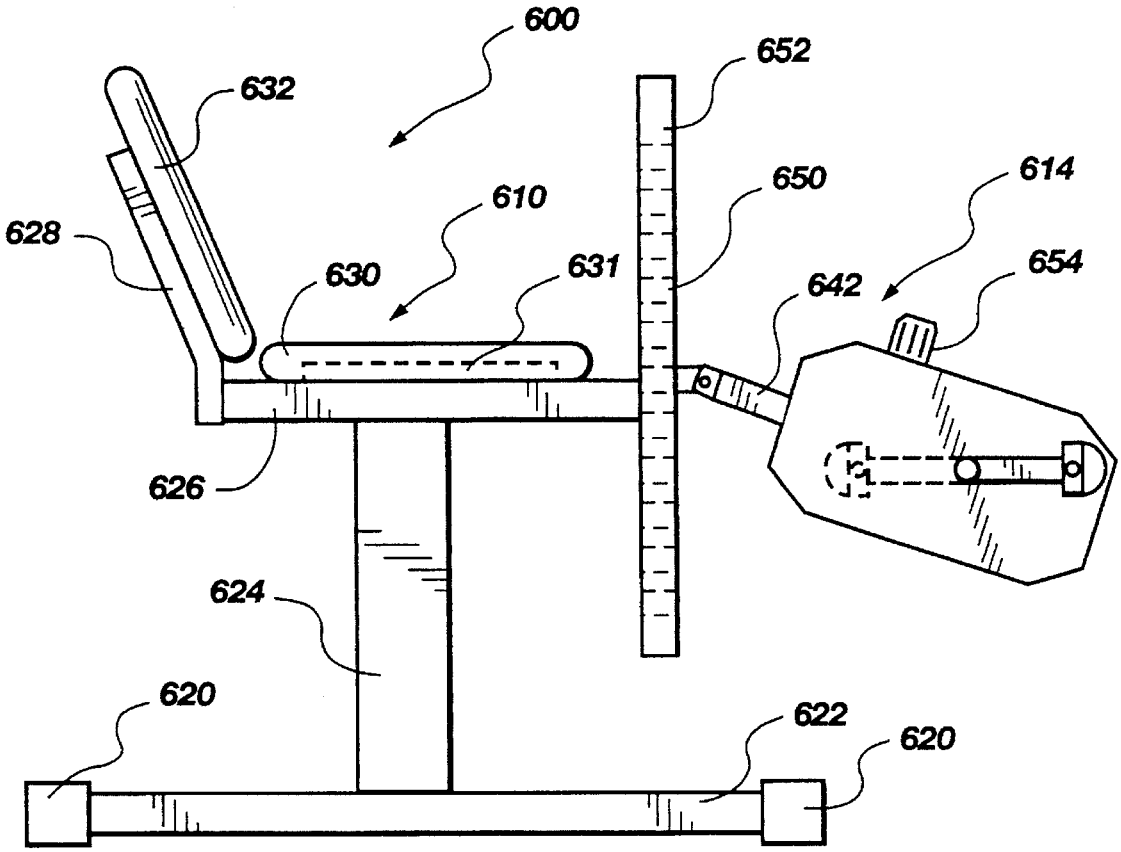
FIG. 14 is a side view of a sixth embodiment of the present invention.
Figure 15:
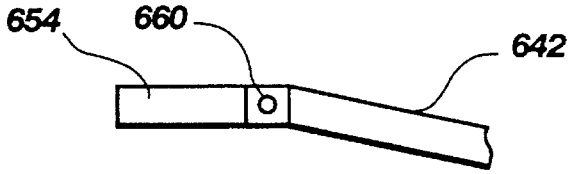
FIG. 15 is a side view of the cylindrical end of the pedal assembly of the sixth embodiment of the present invention.

Referring to drawing FIGS. 14 and 15 another embodiment 600 of the present invention is shown. The frame 610 and pedal assembly 614 are similar to that described hereinbefore. The horizontal seat support 626 has vertical member 650 secured thereto by any suitable means. The vertical member 650 contains a plurality of apertures 652 therein. Located on the end of pedal arm 642 is cylindrical arm end member 654 which engages an aperture 652 of vertical member 650 to support the pedal assembly 614 thereon. Either the apertures 652 or end 654 of pedal arm 642 may be roughened to increase friction therebetween or, alternatively, tapered or both. The pedal assembly 614 is pivotally secured to arm member 654 via threaded fastener 660 engaging an aperture in the end pedal arm 642.

OPERATION OF THE INVENTION

Referring to drawing FIGS. 1 through 4, the multipurpose exercise device 100 is used as follows:

To exercise the legs, a user sits upon seat cushion 130 with their back generally engaging seat back 132, with the pedal assembly 114 oriented generally downwardly with respect to the plane of the seat support 126. The user may place their feet on the pedal faces 151 of pedals 150 to use the pedal assembly 114 to exercise the user's legs with the appropriate amount of tension being placed on belt 180, which engages flywheel 178 by adjusting knob 154. In this position, the pedal arms 148 are oriented on shaft 147 to extend in opposite directions to accomplish the pedaling thereof for exercise. It should be noted that the multiposition pedal adjustment assembly 116 allows the user m readily orient the position of the pedal assembly 114 for use by the user to exercise their legs to any desired position by merely rotating the pedal assembly 114 around pin 164 which extends through aperture 144 in one end of the housing support 142 of pedal assembly 114 and placing pin 166 in any suitable aperture 162 of plates 160 and through aperture 146 in housing support 142.

To exercise the upper body, the user moves the pedal exercise assembly 114 to a substantially vertical position, as shown in phantom in drawing FIG. 1, by pivoting the assembly 114 around pin 164 and replacing pin 166 in the suitable aperture 162 of plates 160 and aperture 146 of housing support 142. In this position, with the pedal arms 148 oriented to extend in opposite directions, the user grasps hand loops 152 and rotates the pedal arms 148 in a circular swimming-type motion to exercise the upper body. Again, using tension knob 154, the tension of the belt 180 on flywheel 178 may be adjusted to the desired amount by the user.

To perform another type upper body exercise with the pedal assembly 114 in a substantially vertical position, the pedal arms 148 are oriented to extend in the same direction by the user removing one arm and reinstalling the same on shaft 147. When the pedal arms 148 extend in the same direction, the user grasps hand loops 152 and rotates the pedal arms 148 in a circular rowing-type motion to exercise the upper body. The tension of belt 180 on flywheel 178 may be adjusted by using knob 154.

From the foregoing, it is readily apparent that the multipurpose exercise device 100 provides the opportunity for a user to perform lower body pedaling-type leg exercises, upper body circular swimming-type exercises and upper body circular rowing-type exercises merely by easily adjusting the orientation of the pedal assembly with respect to the frame 110 and adjusting the orientation of the pedal arms 148.

Referring to drawing FIG. 7, the operation of the multipurpose exercise device 200 is generally as described hereinbefore. Rather than adjusting the tension of a belt on a flywheel to vary the resistance of the pedal assembly in the multipurpose exercise device 200, the relationship of the magnet assembly 255 is varied with respect to the flywheel 253.

As described hereinbefore, the multipurpose exercise device 200 may be used to exercise the lower body through pedaling-type exercises with the legs when the device 200 is in its lower position and the upper body through circular swimming-type exercises and circular rowing-type exercises as hereinbefore described when the device 200 is in its substantially-vertical position, shown in phantom in drawing FIG. 7.

Referring to drawing FIGS. 8 and 9, the operation of the multipurpose exercise device 300 is similar to that described hereinbefore. To use the pedal assembly 314, the leg cushion 330 is removed to allow access thereto for subsequent pedal-type, swimming-type and rowing-type exercises as described hereinbefore.

Referring to drawing FIGS. 10 and 11 to adjust the pedal assembly 414 on pipe 450 threaded fastener 454 is loosened, the pedal assembly 414 moved, and the threaded fastener 454 again tightened. To vary the orientation up and down of the pedal assembly 414 to threaded fastener 456 is used to pivot the pedal assembly 414 thereabout. The operation of the pedal assembly 414 is similar to that described hereinbefore.

Referring to drawing FIGS. 12 and 13 to adjust the pedal assembly 514 the assembly is merely unhooked from an aperture 550 and hooked into another aperture 550 with hook portion 558 engaging the aperture 550 while lug 560 engages the exterior of the bar 550. The operation of the pedal assembly 514 is similar to that described hereinbefore.

Referring to drawing FIGS. 14 and 15 to adjust the pedal assembly 614 the assembly is merely removed from an aperture 652 and reinserted into another. The orientation of the assembly with respect to the bar 650 can be changed via threaded fastener 660 securing cylindrical arm end 654 to pedal arm 642 to pivot the assembly 614 thereabout fastener 660. The operation of the pedal assembly 614 is similar to that described hereinbefore.

Thus, from the foregoing it can be easily seen that the multipurpose exercise device of the present invention provides a variety of types of exercises for a user with the ease of simple pivotal movement of portions of the device with respect to the user without the necessity of any substantial disassembly of the device by merely reorienting portions of the device. It can also be easily seen that the multipurpose exercise device of the present invention may utilize a variety of differing types of mounting of the pedal assembly to the seat frame. Similarly, a variety of resistance mechanisms may be used. As illustrated in the drawings, a flywheel and flywheel belt tension-type apparatus or an eddy brake-type apparatus may be used as resistance mechanisms. If desired, equivalent types of resistance mechanisms connected to the pedal assembly may be used such as an air fan-type resistance device, a caliper brake and wheel-type resistance device or a simple friction disk and brake-type resistance device, etc.

Therefore, the multipurpose exercise device of the present invention provides a variety of types of exercises for a user with convenience of operation.

Having thus described my invention, I claim:

1. A multipurpose pedal-type exercise apparatus for use in exercising the upper body and lower body of a user, said exercise apparatus comprising:

frame means for supporting a user during said exercising the upper body and lower body of a user, the frame means including a first plurality of members, a single vertical support having one end connected to one member of the first plurality of members, and a substantially horizontal seat support connected to the other end of the vertical support;

seat means connected to a portion of the horizontal seat support of the frame means for providing a seat for a user during said exercising the upper body and lower body of a user the seat means including an adjustable seat and rigid back portion connected to a portion of the frame means;

pedal-type exercise means having a portion thereof located proximate the seat means for use by a user during said exercising the upper body and lower body of a user, the pedal-type exercise means including:

a resistance means to provide resistance to operation by a user of the pedal-type exercise means, the resistance means including, in turn, a flywheel apparatus and adjustable tension belt apparatus having a portion thereof engaging a portion of the flywheel apparatus, a support arm means having a longitudinal axis thereof for supporting the flywheel apparatus and adjustable belt tension apparatus, a shaft means rotatably connected to a portion of the support arm means, a first pedal arm having one end thereof connected to one end of the shaft means and the other end having a first pedal connected thereto, the first pedal including a pedal face portion located on one side of the pedal for use in exercising the lower body of a user and a hand loop portion located on the other side of the pedal for use in exercising the upper body of a user, the hand loop portion being substantially parallel to the longitudinal axis of the support arm means, and a second pedal arm having one end thereof connected to the other end of the shaft means and the other end thereof having a second pedal connected thereto, the second pedal including a pedal face portion located on one side of the pedal for use in exercising the lower body of a user and a hand loop portion located on the other side of the pedal for use in exercising the upper body of a user, the hand loop portion being substantially parallel to the longitudinal axis of the support arm means; and a multiposition pedal adjustment assembly having a portion thereof connected to a portion of the horizontal seat support of the frame means and located forward of the seat means connected thereto and another portion thereof connected to a portion of the support arm means of the pedal-type exercise means, the multiposition pedal adjustment assembly providing a user the ability to orient at least a portion of the pedal-type exercise means with respect to a user such that the pedal-type exercise means extends substantially above the seat means to provide the exercising of the upper body of a user and the ability to orient a portion of the pedal-type exercise means with respect to a user such that the pedal-type exercise means extends substantially below the seat means to provide the exercising of the lower body of a user by adjusting the position of a portion of the pedal-type exercise means with respect to the frame means and seat means while a user remains in substantially one position with respect to the frame means and seat means.

2. The multipurpose pedal-type exercise apparatus of claim 1, wherein the seat means further comprises:

seat adjustment means connected to the seat and a portion of the frame means to allow adjustment of a portion of the seat for movement with respect to a portion of the frame means.

3. The multipurpose pedal-type exercise apparatus of claim 1, wherein the adjustable tension belt apparatus includes a spring tension apparatus connected to a portion of the adjustable tension belt and an adjustment knob connected to another portion of the spring tension apparatus to adjust the amount of force the spring tension apparatus exerts on the adjustable tension belt.

4. The multipurpose pedal-type exercise apparatus of claim 1 further comprising:

heating apparatus for selectively heating said user while seated in said multiposition pedal-type exercise apparatus;

vibration apparatus for vibrating said user while seated on said multiposition pedal-type exercise apparatus; and massage apparatus for massaging said user while seated on said multiposition pedal-type exercise apparatus.

5. The multipurpose pedal-type exercise apparatus of claim 1, wherein:

the first pedal arm extends in one direction with respect to the pedal-type exercise means; and the second pedal arm extends in another direction with respect to the pedal-type exercise means.

* * * * *

UNITED STATES PATENT AND TRADEMARK OFFICE

CERTIFICATE OF CORRECTION

PATENT NO. : 5,569,128

DATED : Oct. 29, 1996

INVENTOR(S) : Dalebout

It is certified that error appears in the above-identified patent and that said Letters Patent is hereby corrected as shown below:

Column 1, line 22, after "connected" insert --to--;

Column 3, line 4, change "amy" to --may--;

Column 3, line 34, after "when" delete --in--;

Column 4, line 25, change "aperture 246" to --aperture 262--;

Column 4, line 57, change "244" to --214--;

Column 5, line 2, delete "324";

Column 5, line 8, after "340 and" insert --massage areas--;

Column 6, line 3, after "the user" change "m" to --to--;

Column 6, line 62, please delete the first instance of the word "to";

Column 7, line 46, after "user" insert --,-- (comma).

Signed and Sealed this

Second Day of June, 1998

*Attest:*

*Attesting Officer*

Bruce Lehman

BRUCE LEHMAN

*Commissioner of Patents and Trademarks*